US011272756B2

(12) United States Patent
Torrance

(10) Patent No.: US 11,272,756 B2
(45) Date of Patent: Mar. 15, 2022

(54) DUAL RIGIDITY SHOE SOLE

(71) Applicant: Dashamerica, Inc., Louisville, CO (US)

(72) Inventor: Tony L. Torrance, Boulder, CO (US)

(73) Assignee: DASHAMERICA, INC., Louisville, CO (US)

( * ) Notice: Subject to any disclaimer, the term of this patent is extended or adjusted under 35 U.S.C. 154(b) by 90 days.

(21) Appl. No.: 16/116,166

(22) Filed: Aug. 29, 2018

(65) Prior Publication Data

US 2019/0069627 A1 Mar. 7, 2019

Related U.S. Application Data

(63) Continuation of application No. 13/163,647, filed on Jun. 17, 2011, now abandoned.

(60) Provisional application No. 61/355,643, filed on Jun. 17, 2010.

(51) Int. Cl.

| | |
|---|---|
| ***A43B 5/14*** | (2006.01) |
| ***A43B 13/02*** | (2022.01) |
| ***A43B 13/12*** | (2006.01) |
| ***A43B 13/16*** | (2006.01) |
| ***A43B 13/18*** | (2006.01) |
| ***A43B 7/1445*** | (2022.01) |

(52) U.S. Cl.

CPC ..... *A43B 5/14* (2013.01); *A43B 7/1445* (2013.01); *A43B 13/026* (2013.01); *A43B 13/125* (2013.01); *A43B 13/16* (2013.01); *A43B 13/188* (2013.01)

(58) Field of Classification Search

CPC ..... A43B 5/14; A43B 13/026; A43B 13/04; A43B 13/10; A43B 13/12; A43B 13/122; A43B 13/125; A43B 13/127; A43B 13/188

See application file for complete search history.

(56) References Cited

U.S. PATENT DOCUMENTS

| | | | | |
|---|---|---|---|---|
| 1,923,169 | A | 8/1933 | Simmons | |
| 2,376,854 | A | 5/1945 | Saunders | |
| 3,310,889 | A | 3/1967 | Sameuls | |
| 3,522,669 | A | 8/1970 | Simon | |
| 4,445,286 | A | 5/1984 | Norton | |
| 4,633,877 | A * | 1/1987 | Pendergast ..... | A43B 7/14 36/140 |

(Continued)

FOREIGN PATENT DOCUMENTS

| | | |
|---|---|---|
| CN | 2275375 | 3/1998 |
| CN | 102309090 | 1/2012 |

(Continued)

OTHER PUBLICATIONS

Office Action dated Aug. 29, 2013 in AU2011268142.

(Continued)

*Primary Examiner* — Megan E Lynch

(74) *Attorney, Agent, or Firm* — Jeffer Mangels Butler & Mitchell LLP; Brennan C. Swain, Esq.

(57) ABSTRACT

The invention provides bicycling shoes having soles containing materials of at least two different material densities configured to provide improved comfort, and fit for a wearer when walking or running in the shoes, while providing enhanced force transfer from the wearer to a bicycle pedal when bicycling in the shoes.

8 Claims, 8 Drawing Sheets

(56) References Cited

U.S. PATENT DOCUMENTS

D288,027 S 2/1987 Tonkel
4,651,445 A 3/1987 Ahannibal
4,694,589 A 9/1987 Sullivan
4,697,362 A * 10/1987 Wasserman ..... A43B 3/0078 36/136
4,712,314 A * 12/1987 Sigoloff ..... A43B 1/0072 36/112
4,825,565 A * 5/1989 Bigolin ..... A43B 5/14 36/131
4,833,796 A 5/1989 Flemming
4,845,864 A 7/1989 Corliss
D303,451 S 9/1989 Weiner
4,876,808 A * 10/1989 Hsieh ..... A43B 5/14 36/131
4,907,355 A * 3/1990 Allen ..... A43B 5/14 36/131
4,910,883 A 3/1990 Zock
4,918,838 A 4/1990 Chang
4,942,677 A 7/1990 Flemming
5,007,185 A * 4/1991 Lazarski ..... A43B 5/14 36/131
5,035,069 A 7/1991 Minden
5,052,130 A 10/1991 Barry
5,086,576 A * 2/1992 Lamson ..... A43B 5/14 36/131
5,117,567 A 6/1992 Berger
5,125,173 A * 6/1992 Nagano ..... A43B 5/14 36/131
5,131,291 A * 7/1992 Beyl ..... A43B 5/14 36/131
5,154,682 A 10/1992 Kellerman
5,177,882 A 1/1993 Berger
5,179,791 A 1/1993 Lain
5,337,492 A 8/1994 Anderie
5,363,526 A * 11/1994 Okajima ..... A43B 5/14 12/133 B
5,406,723 A * 4/1995 Okajima ..... A43B 5/049 36/131
5,446,977 A * 9/1995 Nagano ..... A43B 5/14 36/131
5,461,800 A 10/1995 Luthi
5,511,325 A 4/1996 Heiblinger
5,572,805 A * 11/1996 Giese ..... A43B 13/12 36/103
5,611,152 A * 3/1997 Richard ..... A43B 13/12 36/27
5,628,129 A 5/1997 Kilgore
5,636,456 A 6/1997 Allen
5,657,558 A * 8/1997 Pohu ..... A43B 5/14 36/100
5,678,327 A 10/1997 Halberstadt
5,685,093 A * 11/1997 Lin ..... A43B 1/0054 36/131
5,687,492 A * 11/1997 Muraoka ..... A43B 5/14 36/11.5
D387,890 S 12/1997 Fualconer
5,709,954 A 1/1998 Lyden
D390,348 S 2/1998 Meyer
5,737,854 A 4/1998 Sussmann
5,761,831 A 6/1998 Cho
5,832,634 A 11/1998 Wong
5,836,094 A * 11/1998 Figel ..... A43B 3/0073 36/131
5,897,515 A 4/1999 Willner
D409,362 S 5/1999 Turner
D412,612 S 8/1999 Boyer
5,934,599 A 8/1999 Hammerslag
5,940,994 A 8/1999 Allen
D417,943 S 12/1999 Solaroli
6,006,449 A 12/1999 Orlowski
6,009,641 A * 1/2000 Ryan ..... A43B 5/14 36/107
6,038,790 A * 3/2000 Pyle ..... A43B 7/1425 36/28
6,076,283 A 6/2000 Boie
6,079,125 A 6/2000 Quellais
D428,238 S 7/2000 Price
D432,294 S 10/2000 Wilson
6,145,221 A 11/2000 Hockerson
6,189,242 B1 * 2/2001 Lin ..... A43B 5/14 36/117.1
6,260,291 B1 * 7/2001 Farys ..... A43B 5/14 36/107
6,289,558 B1 9/2001 Hammerslag
D456,982 S 5/2002 Rogers
D4,600,853 7/2002 Sakai
6,477,793 B1 * 11/2002 Pruitt ..... A43B 5/14 36/103
6,505,424 B2 1/2003 Oorei
D473,698 S 4/2003 St.-Louis
6,574,889 B2 6/2003 Cagner
6,601,042 B1 7/2003 Lyden
D484,674 S 1/2004 Issler
D487,184 S 3/2004 Issler
6,726,985 B2 4/2004 Amitai
D490,220 S 5/2004 Edauw
6,742,286 B2 6/2004 Giovale
D493,951 S 8/2004 Adams
6,782,639 B1 8/2004 Muller
D496,779 S 10/2004 Belley
D499,534 S 12/2004 McClaskie
D501,294 S 2/2005 Robbins
D504,007 S 4/2005 Cintron
D507,096 S 7/2005 Chen
D508,160 S 8/2005 Sonnergren
D508,307 S 8/2005 Burger
6,922,917 B2 8/2005 Kerns
6,948,262 B2 9/2005 Kerrigan
6,948,264 B1 9/2005 Lyden
D514,288 S 2/2006 Burg
7,016,867 B2 3/2006 Lyden
7,076,892 B2 7/2006 Meschan
7,096,605 B1 * 8/2006 Kozo ..... A43B 7/08 36/103
7,100,309 B2 9/2006 Smith
7,107,235 B2 9/2006 Lyden
D532,585 S 11/2006 McDonald
D536,517 S 2/2007 Gerber
7,178,272 B2 * 2/2007 Xie ..... A43B 5/14 36/131
D541,019 S 4/2007 McClaskie
D543,340 S 5/2007 Favreau
7,213,354 B1 * 5/2007 Byrd ..... A43B 3/0031 36/136
7,219,450 B2 5/2007 Langley
D546,532 S 7/2007 Matis
7,290,357 B2 11/2007 McDonald
D556,980 S 12/2007 Bramani
7,334,351 B2 2/2008 Hann
D566,935 S 4/2008 Matis
D566,938 S 4/2008 Matis
7,377,057 B2 5/2008 Lacorazza
7,383,647 B2 6/2008 Chan
7,401,424 B2 7/2008 Kerns
D574,130 S 8/2008 Le
D575,040 S 8/2008 Bramani
D586,991 S 2/2009 Fuerst
7,487,604 B2 2/2009 Perron, Jr.
7,533,480 B2 * 5/2009 Chao ..... A43B 5/14 36/131
D593,740 S 6/2009 McClaksie
D594,195 S 6/2009 Nakano
D596,385 S 7/2009 McDade
D602,237 S 10/2009 Roundhouse
D602,683 S 10/2009 Roundhouse
7,762,008 B1 7/2010 Clark
7,779,557 B2 8/2010 Teteriatnikov
7,814,683 B2 10/2010 Lee
D632,879 S 2/2011 Merkazy
7,877,897 B2 2/2011 Teteriatnikov

(56) References Cited

U.S. PATENT DOCUMENTS 7,887,897 B2 2/2011 Lu
7,941,941 B2 5/2011 Hazenberg
7,946,058 B2 5/2011 Johnson
8,082,684 B2 12/2011 Munns
D657,941 S 4/2012 Bramani
D659,361 S 5/2012 Jolicoeur
8,166,672 B2 5/2012 Murphy
D671,301 S 11/2012 Dombrow
D676,224 S 2/2013 Marshall
D683,117 S 5/2013 Truelsen
D693,101 S 11/2013 Dombrow
D695,505 S 12/2013 Hansen
D697,296 S 1/2014 Loyley
8,621,767 B2 1/2014 Vestuti
8,631,590 B2 1/2014 Droege
D709,275 S 7/2014 Tucker
8,776,397 B2 7/2014 Borel
D710,079 S 8/2014 Tucker
D711,083 S 8/2014 Tucker
D712,122 S 9/2014 Tucker
D713,135 S 9/2014 Tucker
D715,522 S 10/2014 Tucker
2001/0022041 A1* 9/2001 Gebhard ..... A43B 5/14 36/131
2002/0062578 A1 5/2002 Lussler
2002/0112373 A1* 8/2002 Talbott ..... A43B 5/06 36/25 R
2002/0144429 A1 10/2002 Hay
2003/0051574 A1* 3/2003 Muraoka ..... B62M 3/086 74/594.6
2003/0056397 A1* 3/2003 Hsiao ..... A43B 13/125 36/31
2003/0084595 A1* 5/2003 Weiss ..... A43B 1/0072 36/83
2003/0088996 A1 5/2003 Hall
2004/0020075 A1* 2/2004 Garneau ..... A43B 5/14 36/3 B
2004/0068891 A1 4/2004 Wang
2004/0107601 A1 6/2004 Schmid
2004/0148809 A1* 8/2004 Kikuta ..... A43B 5/14 36/131
2004/0153168 A1 8/2004 Childress
2004/0187635 A1* 9/2004 Bryne ..... B62M 3/086 74/594.4
2004/0205983 A1* 10/2004 Talbott ..... A43B 5/06 36/134
2005/0016028 A1 1/2005 Safdeye
2005/0022432 A1* 2/2005 Chretien ..... A43B 5/14 36/131
2005/0034328 A1* 2/2005 Geer ..... A43B 3/0036 36/30 R
2005/0060909 A1* 3/2005 Kerns ..... A43B 7/1425 36/28
2005/0160630 A1 7/2005 Perron, Jr.
2005/0166422 A1 8/2005 Schaeffer
2005/0198866 A1 9/2005 Scholz
2005/0210712 A1* 9/2005 Jau ..... A43B 5/14 36/131
2006/0000113 A1* 1/2006 Hsueh-Cheng ..... A43B 7/142 36/28
2006/0010716 A1* 1/2006 Kerns ..... A43B 5/14 36/25 R
2006/0016102 A1* 1/2006 Xie ..... A43B 5/14 36/131
2006/0123664 A1* 6/2006 Boyd ..... A43B 7/1425 36/44
2006/0201035 A1* 9/2006 Signori ..... A43B 5/14 36/131
2006/0277796 A1* 12/2006 Gallegos ..... A43B 1/0054 36/44
2006/0277799 A1* 12/2006 Lebo ..... A43B 13/026 36/102
2007/0033834 A1* 2/2007 Cheskin ..... A43B 7/141 36/44
2007/0039208 A1* 2/2007 Bove ..... A43B 3/26 36/97
2007/0039209 A1* 2/2007 White ..... A43B 3/26 36/97
2007/0094892 A1* 5/2007 Craig ..... A43B 7/1415 36/10
2007/0128403 A1* 6/2007 Yang ..... A43B 13/188 428/67
2007/0277401 A1* 12/2007 Young-Chui ..... A43B 13/12 36/30 R
2007/0295451 A1* 12/2007 Willis ..... A43B 7/144 156/306.6
2008/0016724 A1 1/2008 Hlavac
2008/0034615 A1 2/2008 Nishiwaki
2008/0148598 A1* 6/2008 Schoenborn ..... A43B 7/144 36/28
2008/0148599 A1* 6/2008 Collins ..... A43B 7/28 36/44
2008/0163513 A1 7/2008 Chapman
2008/0216355 A1* 9/2008 Becker ..... A43B 13/026 36/102
2008/0276496 A1 11/2008 Kerns
2008/0289215 A1* 11/2008 Park ..... A43B 7/144 36/28
2008/0289220 A1* 11/2008 Rivas ..... A43B 3/0036 36/88
2009/0019730 A1* 1/2009 Salminen ..... A43B 7/1425 36/91
2009/0064535 A1* 3/2009 Spanks ..... A43B 3/0078 36/19.5
2009/0071040 A1* 3/2009 Fergus ..... A43B 13/02 36/25 R
2009/0084000 A1* 4/2009 Pai ..... A43B 7/142 36/91
2009/0113757 A1* 5/2009 Banik ..... A43B 7/144 36/28
2009/0113767 A1* 5/2009 Lee ..... A43B 1/0045 36/3 B
2009/0172971 A1* 7/2009 Peikert ..... A43B 7/125 36/88
2009/0178303 A1 7/2009 Hurd
2009/0183393 A1 7/2009 Lee
2009/0211115 A1 8/2009 Geer
2009/0249656 A1 10/2009 Shelton
2009/0313856 A1 12/2009 Arizumi
2009/0320330 A1* 12/2009 Borel ..... A43B 13/026 36/30 R
2010/0005684 A1* 1/2010 Nishiwaki ..... A43B 7/1425 36/28
2010/0031531 A1* 2/2010 Baucom ..... A43B 13/188 36/44
2010/0071232 A1* 3/2010 Steele ..... A43B 3/30 36/91
2010/0122471 A1* 5/2010 Edington ..... A43B 7/144 36/28
2010/0146821 A1* 6/2010 Bryne ..... A43B 5/14 36/134
2010/0154252 A1* 6/2010 Avent ..... A43B 7/1445 36/91
2010/0192421 A1* 8/2010 Kerns ..... A43B 5/14 36/3 B
2010/0269374 A1* 10/2010 Hsieh ..... A43B 5/14 36/25 R
2010/0293811 A1 11/2010 Truelsen
2010/0293816 A1* 11/2010 Truelsen ..... A43B 5/06 36/30 R
2010/0299968 A1* 12/2010 Matsueda ..... A43B 5/00 36/134
2010/0313450 A1* 12/2010 Morgan ..... A43B 13/12 36/17 R
2011/0016753 A1* 1/2011 Duvillard ..... A43B 7/28 36/30 R
2011/0035960 A1 2/2011 Werremeyer

(56) References Cited

U.S. PATENT DOCUMENTS

| | | | | |
|---|---|---|---|---|
| 2011/0047720 | A1* | 3/2011 | Maranan | A43B 13/125 12/146 B |
| 2011/0047816 | A1 | 3/2011 | Nurse | |
| 2011/0067268 | A1* | 3/2011 | Lubart | A43B 13/026 36/92 |
| 2011/0107622 | A1* | 5/2011 | Schwirian | A43B 5/14 36/30 A |
| 2011/0113649 | A1* | 5/2011 | Merritt | A43B 13/145 36/102 |
| 2011/0138652 | A1 | 6/2011 | Lucas | |
| 2011/0138658 | A1* | 6/2011 | Ueda | A43B 5/14 36/131 |
| 2011/0185590 | A1 | 8/2011 | Nishiwaki | |
| 2011/0197469 | A1 | 8/2011 | Nishiwaki | |
| 2011/0209360 | A1* | 9/2011 | Baker | A43B 7/1435 36/44 |
| 2011/0214313 | A1 | 9/2011 | James | |
| 2011/0232135 | A1* | 9/2011 | Dean | A43B 13/16 36/25 R |
| 2011/0252670 | A1* | 10/2011 | Smith | A43B 13/023 36/25 R |
| 2011/0277355 | A1* | 11/2011 | Fahmi | A43B 7/1405 36/30 R |
| 2012/0047771 | A1* | 3/2012 | Delacruz | A43B 3/0031 36/103 |
| 2013/0152428 | A1 | 6/2013 | Bishop | |
| 2014/0013626 | A1 | 1/2014 | James | |
| 2014/0047740 | A1 | 2/2014 | Tucker | |
| 2014/0068880 | A1 | 3/2014 | Torrance | |

FOREIGN PATENT DOCUMENTS

| | | |
|---|---|---|
| CN | 102309091 | 1/2012 |
| EP | 0272082 | 6/1988 |
| EP | 0726037 | 8/1996 |
| EP | 1832191 | 9/2007 |
| EP | 1832192 | 9/2007 |
| FR | 2775424 | 9/1999 |
| GB | 2239780 | 7/1991 |
| GB | 2256784 | 12/1992 |
| JP | H04-327801 | 11/1992 |
| JP | H05-76304 | 10/1993 |
| JP | H07-308205 | 11/1995 |
| JP | H-09-10003 | 1/1997 |
| JP | 2000-125905 | 5/2000 |
| WO | 1987007481 | 12/1987 |
| WO | 1996000512 | 1/1996 |
| WO | 2003002042 | 1/2003 |
| WO | 2004113058 | 12/2004 |
| WO | 2010037028 | 4/2010 |
| WO | 2010051657 | 5/2010 |
| WO | 2010141425 | 12/2010 |

OTHER PUBLICATIONS

Office Action dated Feb. 21, 2014in AU2011268142.
Notice of Allowance dated May 14, 2014 in AU2011268142.
Office Action dated May 20, 2014 in CA2802538.
Office Action dated Feb. 17, 2015 in CA2802538.
Office Action dated Jan. 4, 2016 in CA2802538.
Extended Search Report dated Nov. 6, 2017 in EP11796541.8.
Office Action dated May 12, 2015 in JP2013-515560.
Office Action dated Mar. 8, 2016 in JP2013-515560.
Office Action dated Jun. 28, 2016 in JP2013-515560.
Office Action dated Aug. 2, 2013 in NZ604514.
Notice of Allowance dated Jun. 18, 2014 in NZ604514.
International Search Report dated Oct. 28, 2011 in PCT/US 2011/040944.
International Preliminary Report on Patentability dated Jan. 3, 2013 in PCT/US 2011/040944.
Dugan et al. "Biomechanics and Analysis of Running Gait," Phys. Med. and Rehab. Clinics of North America, 2005, vol. 16, No. 3, pp. 603-621. "Carbon (fiber)," Wikipedia, retrieved on Feb. 27, 2011. http://en.wikipedia.org/wiki/Carbon_(fiber).
"Carbon fiber-reinforced polymer," Wikipedia, retrieved on Feb. 27, 2011. http://en.wikipedia.org/wiki/Carbon_fiber-reinforced_polymer.
"Composite material," Wikipedia, retrieved on Feb. 26, 2011. http://en.wikipedia.org/wiki/Composite_material.
"Deformation (mechanics)," Wikipedia, retrieved on Feb. 27, 2011. http://en.wikipedia.org/wiki/Deformation_(mechanics).
"Pre-preg," Wikipedia, retrieved on Sep. 25, 2013 http://en.wikipedia.org/w/index.php?title=Pre-preg&direction=prev&oldid=406926465.
"Carbon (fiber)," Wikipedia, retrieved on Feb. 27, 2011 http://en.wikipedia.org/wiki/Carbon_(fiber).

* cited by examiner

DUAL RIGIDITY SHOE SOLE

CROSS REFERENCE TO RELATED APPLICATION

This application is a continuation of U.S. patent application Ser. No. 13/163,647, filed Jun. 17, 2011, which claims the benefit of U.S. Provisional Application Ser. No. 61,355,643, filed Jun. 17, 2010, which are each incorporated herein by reference in their entireties.

TECHNICAL FIELD

The invention relates to articles of footwear useful for touring or commuting by bicycle.

BACKGROUND OF INVENTION

When riding a bicycle, the largest force produced by the bicyclist is transmitted from the knee, through the foot to the bicycle pedal. A recreational bicyclist typically reproduces the pedaling force about 4,500 to about 7,500 times an hour. Unlike many bicycle shoes designed for road bicycle racing, mountain biking or commuter biking shoes typically have recessed cleats and a more flexible sole designed to allow the cyclist to comfortably walk or run when they dismount the bicycle. The flexible rubber sole, while flexible and cushioning for walking or running, unfortunately leads to inefficiencies and a loss of energy expended by the rider when energy from the rider's foot to the pedal, energy is lost in compression or flexing of the sole of the shoe between the rider's foot and the pedal. Though a completely rigid sole material renders a bicycling shoe more efficient by reducing energy loss, it is difficult to use when the rider dismounts the bicycle, for example, during portions of a mountain bike race or while commuting by bicycle.

Thus, there is a desire in the art for a bicycling shoe that can both efficiently transfer energy between the riders' foot and the pedal, while remaining flexible and providing sufficient cushion for comfortable running or walking when the wearer is off of the bicycle.

SUMMARY OF THE INVENTION

The present invention provides bicycling shoes, having dual rigidity materials in the soles that are comfortable for walking while providing efficient energy transfer from the rider to the pedal when bicycling. The sole of the invention allows for more rigid or stiff materials in the pedal or cleat region of the shoe, proximate the metatarsal region of the rider's foot, thereby minimizing the energy loss experienced between the rider's foot and pedal when the rider is bicycling. The shoe sole of the invention allows for less rigid or stiff (i.e. more flexible) materials in the heel and toe regions of the foot, providing for greater flexibility and comfort, injury prevention and ease of use when the rider is running or walking dismounted from the bicycle.

It will be appreciated that with respect to most materials used in the fabrication of athletic shoes, and particularly bicycle shoes, the stiffness and rigidity of the material corresponds directly with its density. That is, with respect to most materials, particularly plastic/polymeric materials, the greater the density of the material, the greater is the stiffness/rigidity of the material. It should also be understood, however, that this relationship between density and rigidity does not hold for across every material that can be used in the fabrication of athletic shoes.

Other features, utilities and advantages of the invention will be apparent from the following description of embodiments of the invention as illustrated in the accompanying drawings.

DESCRIPTION OF EMBODIMENTS

The present invention is drawn to an athletic shoe sole that provides enhanced comfort while walking and efficient energy transfer from foot to bicycle pedal when bicycling.

Figure 1:
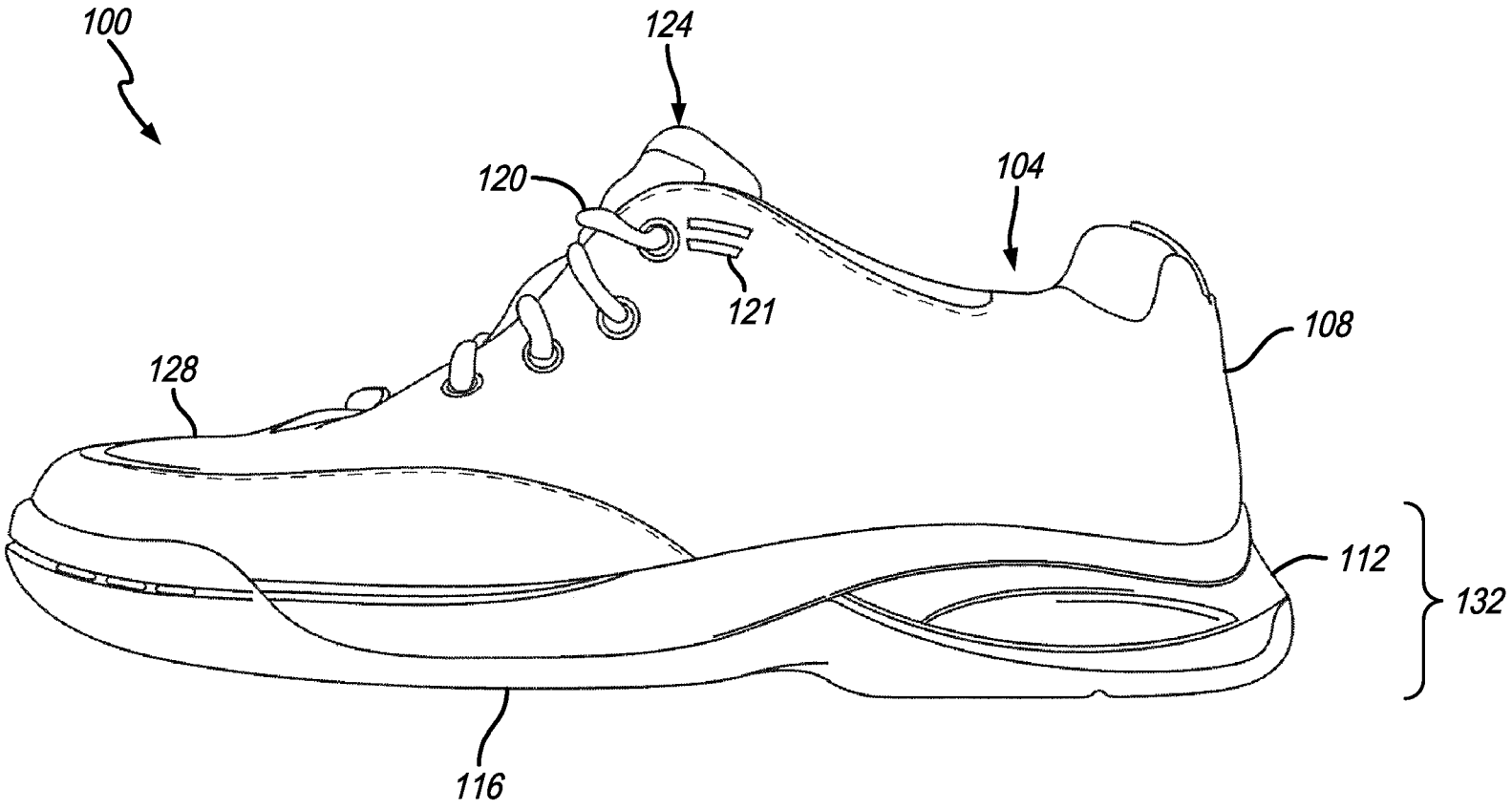
FIG. 1, illustrates a side view of a shoe comprising a dual rigidity midsole of one embodiment of the invention.

FIGS. 1 to 6 depict embodiments of the present invention. FIG. 1 shows a bicycling shoe 100 including an outersole 116, an upper 108, and a midsole 112 having at least two materials of different densities. The upper 108, may include a closure system 120, that can be any system capable of securing the shoe 100 to the riders' foot. The closure system may include shoelaces, a plurality of hook and loop (Velcro™) straps, zippers, and/or cords in conjunction with a dial to tighten the cords with even force across the throat of the shoe 100.

The upper 108 is attached to the midsole 112, which is attached to the outersole 116. As used throughout this specification, attachments may be made by conventional methods known in the art, such as stitching, welding and adhesive bonding. The upper 108 of the shoe 100 is composed of one or more durable materials. Preferably, the durable material comprises one or more material(s) including but not limited to natural or synthetic leather, a polymeric material, a polymeric mixture, a polymeric alloy, a laminate, a natural or synthetic textile material, a mesh material, or a combination thereof. Preferably, the durable material is a flexible, that is, the material has substantial flexibility to provide tightening and/or securing of the upper 108 about the riders' foot by the closure system 120. In one configuration, the upper 108 (optionally including a tongue 124) is composed of two or more durable materials. For example, the toe box 128 may be composed of one material (such as a mesh material) while the reminder of the upper 108, or any other section of the upper 108, is composed of another material. The upper 108 is suitable for providing manufacturer, team or sponsor logos, as desired.

The upper 108 optionally contains a plurality of vent voids 121 that provide for fluid and air flow into and out of the interior cavity 104. At least most, if not all, of these vent voids 121 are positioned about the tongue 124, toe box 128, vamp and quarter of the bicycling shoe 100. In one embodiment, venting voids 121 are positioned about the tongue 124, vamp and quarter of the bicycling shoe 100. But it should be understood that the venting voids 121 may be placed in any position on the bicycling shoe 100. Furthermore, the venting voids 121 may be any suitable shape or size. The upper may also optionally include advertising, such as for a brand, team or other advertisement.

As used herein the term bicycling shoe means both left and right forms of the bicycling shoe 100. Furthermore, the bicycling shoe 100 comprises a bicycling shoe designed to fit a man, a woman, or both. The bicycling shoe 100 may have a shoe size according to any international shoe size designation standard. For example, without limitation, the shoes of the invention may have a size designation from the United States standard shoe size designations of: 5, 5½, 6, 6½, 7, 7½, 8, 8½, 9, 9½, 10, 10½, 11, 11½, 12, 12½, 13, 13½, 14, 14½, 15, 15½, 16, 16½, 17, 17½, 18, 18½, 19, 19½, and 20 and a width from the United States standard widths of: AAA, AA, A, B, C, D, E, EE, EEE, EEEE, F and G.

The sole 132 includes a midsole 112 and an outersole 116 and may include an insole being in an opposing relationship to the outersole 116. In one embodiment, the midsole 112 is composed of at least two materials having different material densities. The sole 132 may also include inserts. These inserts may be located throughout the sole 132. By way of example, the inserts may be located in the arch or heel region of the sole. Inserts may also be located in the metatarsal region and positioned such that they do not interfere with a cleat positioned on the bottom of the shoe.

Figure 2:
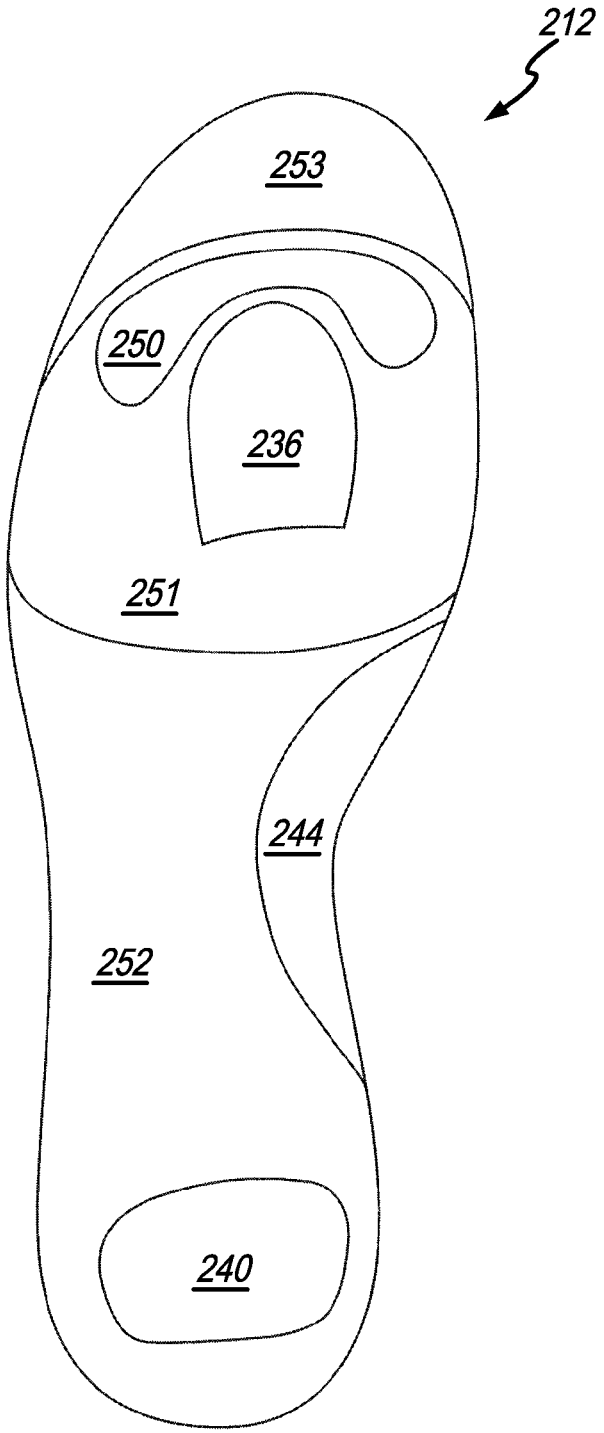
FIG. 2, illustrates a bottom view of a dual rigidity midsole of one embodiment of the invention.

FIG. 2 shows a bottom view of a midsole 212 of one embodiment of the invention. The midsole 212 may comprise at least two materials having different material densities. The cleat region 236 spans at least a portion of the metatarsal region of the midsole 212 where the sole of the shoe may be engaged with a bicycle pedal and may be any suitable shape. The cleat region 236 of the midsole 212, comprises a material that is dense, and thus more rigid than the material comprising at least the rear midsole region 252 of the midsole 212. The denser material in the cleat region 236 allows for reduced energy loss and increased efficiency when the cyclist is pedaling. The dense material of the cleat region 236 may be any suitably durable material, including but not limited to, a polymer, a metal, wood, a composite, a foam, a reinforced polymer, or combinations thereof. In one embodiment, the cleat region 236 of the midsole 212 contains a rigid plastic material or polymer composite. In another embodiment, the cleat region 236 of the midsole 212 contains a plurality of carbon fibers, and more preferably, a plurality of carbon fibers configured in a unidirectional alignment or layer to form a light, rigid material. Preferably, the material comprising the cleat region 236 of the midsole 212 is a lightweight material. The cleat region 236 of the midsole 212 may be any suitable shape or size to transfer force from the rider to the pedal. The cleat region 236 may also be configured to receive or include a cleat for attaching to a pedal. The cleat region 236 may extend into other regions of the midsole 212. Furthermore, the thickness of the cleat region 236 may vary.

FIG. 2 also illustrates additional regions of the midsole 212, including the central midsole 251, the rear midsole 252, and the fore midsole 253. The material of the central midsole 251, the rear midsole 252 and/or the fore midsole 253 may differ from the material of the cleat region 236. The material may be a lower rigidity material that provides comfort and flexibility to the rider when off of the bicycle, while not interfering with the high rigidity material of the cleat region 236. In other embodiments, the materials of the central midsole 251, the rear midsole 252 and/or the fore midsole 253, may be the same lower rigidity material or they may be composed of different materials or different formulations/densities of the same material in order to form materials having different rigidity or stiffness compared to one another. In optional embodiments, the higher rigidity material of the cleat region 236 may extend to the central midsole 251 and even to portions of the rear midsole 252. Alternatively, the central midsole 251 may be composed of the same low rigidity material as the rear midsole 252 and/or the fore midsole 253.

In a specific embodiment, the fore midsole 253, and the rear midsole 252 comprise a low rigidity material that is comfortable to walk or run in should the rider dismount the bicycle, while the cleat region 236 and the central midsole 251, contains a higher rigidity, rigid material that allows for efficient transfer of force from the rider's foot to the pedal through the central midsole 251 and cleat region 236 of the bicycling shoe.

In each of these embodiments, the less dense material can be any suitable material, including but not limited to, leather, a polyurethane foam, canvas, rubber, EVA, polyester, nylon, nylon textiles, thermoplastic polyurethane, composite, a polymer, foam or combination thereof, or any other suitable material or similar material to provide an appropriate combination of support and comfort to the user. The low rigidity material may contain a unidirectional carbon fiber laminate, which may also contain one or more of a polymeric material, a polymeric mixture, a polymeric alloy or combinations of these polymeric materials. The midsole 212 can be formed as one continuous piece containing the high rigidity and the low rigidity materials, separated into distinct regions of the midsole 212, or it may be formed as two or more distinct pieces that are nested or connected together to form the midsole having distinct regions of lower and higher rigidity.

Optional embodiments that are also illustrated in FIG. 2 allow for one or more of a heel insert 240, a metatarsal insert 250, and/or an arch insert 244, or any combination thereof, within the midsole 212. In these optional embodiments, a heel insert 240, and/or a metatarsal insert 250, and/or an arch insert 244 may be individually or collectively incorporated into the midsole 212. The heel insert 240 can provide additional cushioning and support to the heel portion of the midsole 212. The metatarsal insert 250 can add additional rigidity and support to a portion of the metatarsal region. The arch insert 244 can provide added support to the arch area of the wearer's foot. The inserts of the invention may be chosen to adjust the level of support in the metatarsal, arch and heel regions. In a preferred embodiment, the inserts generally have the same shape as the insert slot that they fit into so that they can be inserted into the slot and substantially fill the slot in order to provide support and comfort for the user. The inserts may be used individually, or they may be stacked with other inserts to vary the thickness of the inserts. The inserts may be any suitable material, but are preferably a substantially pliable material, such as a foam, including a ethylene vinyl acetate foam or other open cell foams or cork or other polymer materials. The inserts may also be made of rubber, canvas, leather, EVA, nylon, polyester, nylon textiles, thermoplastic polyurethane, composites, laminates or other suitable structural material or combinations thereof. The insert(s) may be colored, or may be translucent. In certain embodiments, it is preferable for the inserts to be substantially rigid so as to transfer power, for example, while the user is pedaling a bicycle. In this configuration, the inserts may be a substantially rigid material, including but not limited to a polymer, a metal or wood. Furthermore, the inserts may contain additional materials or material layers for antimicrobial or antifungal protection, or fragrances.

The metatarsal insert 250, the arch insert 244 and the heel insert 240 can individually be incorporated into the midsole 212 of the shoe. The metatarsal insert 250, the arch insert 244 and the heel insert 240 may also individually be present or absent in the midsole such that these inserts can be combined in varying combinations in the midsole or all of these inserts may be incorporated into the midsole. These inserts may also assist in absorbing shock in the sole of the shoe when the rider is walking or running in the shoe, when dismounted from the bicycle. The inserts may be any suitable shape and any suitable material, including but not limited to a polyurethane foam, leather, canvas, rubber, EVA, polyester, nylon, nylon textiles, thermoplastic polyurethane or any other suitable material or similar material to provide an appropriate combination of stiffness/rigidity and flexibility to the user.

If present, the optional metatarsal insert 250 does not interfere with the attachment of a cleat on the bicycle shoe to a bicycle pedal about the cleat region 236 of the midsole. The optional metatarsal insert 250 may contain rigid materials similar or identical to the cleat region 236 of the midsole 212, such that there is minimal detrimental effect or even a beneficial effect on the efficient transfer of force from the wearer's foot to a bicycle pedal in the central midsole region 251.

Figure 3:
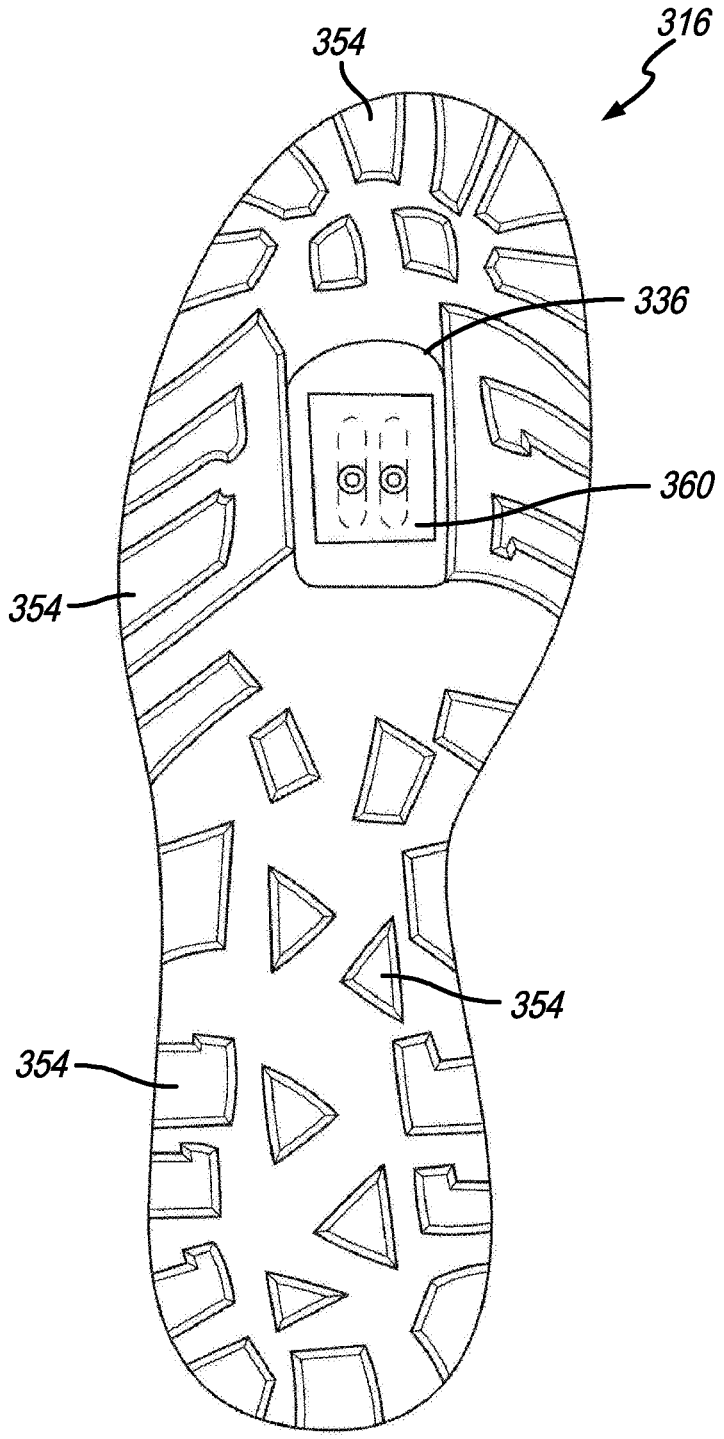
FIG. 3, illustrates a bottom view of an outersole of one embodiment of the invention.

FIG. 3 illustrates a bottom view of the dual rigidity sole with an outersole 316. The cleat region 336 is robust and allows for a variety of cleat attachment elements, including the specific cleat attachment element 360 depicted in FIG. 3, to securely attach a bicycle cleat or clip to the cleat region 336 of the outersole 316 of the bicycle shoe. The cleat attachment element 360 may be any element adapted to attach to a bicycle pedal. The cleat attachment element 360 is situated on the cleat region 336 of the midsole, but is exposed through the outersole 316, proximate the metatarsal region of the wearer's foot.

FIG. 3 also illustrates an optional tread element 354, which can be located throughout sections of the outersole 316 as desired. The tread element 354 may be composed on the outersole 316 as a continuous piece or the thread element(s) 354 may be individually attached to the outersole 316 in any acceptable manner. Typically, the tread element (s) 354, if present, are molded into the outersole 316 when the outersole 316 is formed. The tread elements 354 may be configured in a variety of different shapes and depths, as desired to accommodate the activities and preferences of the wearer. The outersole 316, and any tread elements present, preferably comprise a polymeric material, typically a rubber or a similar type of material.

Figure 4A:
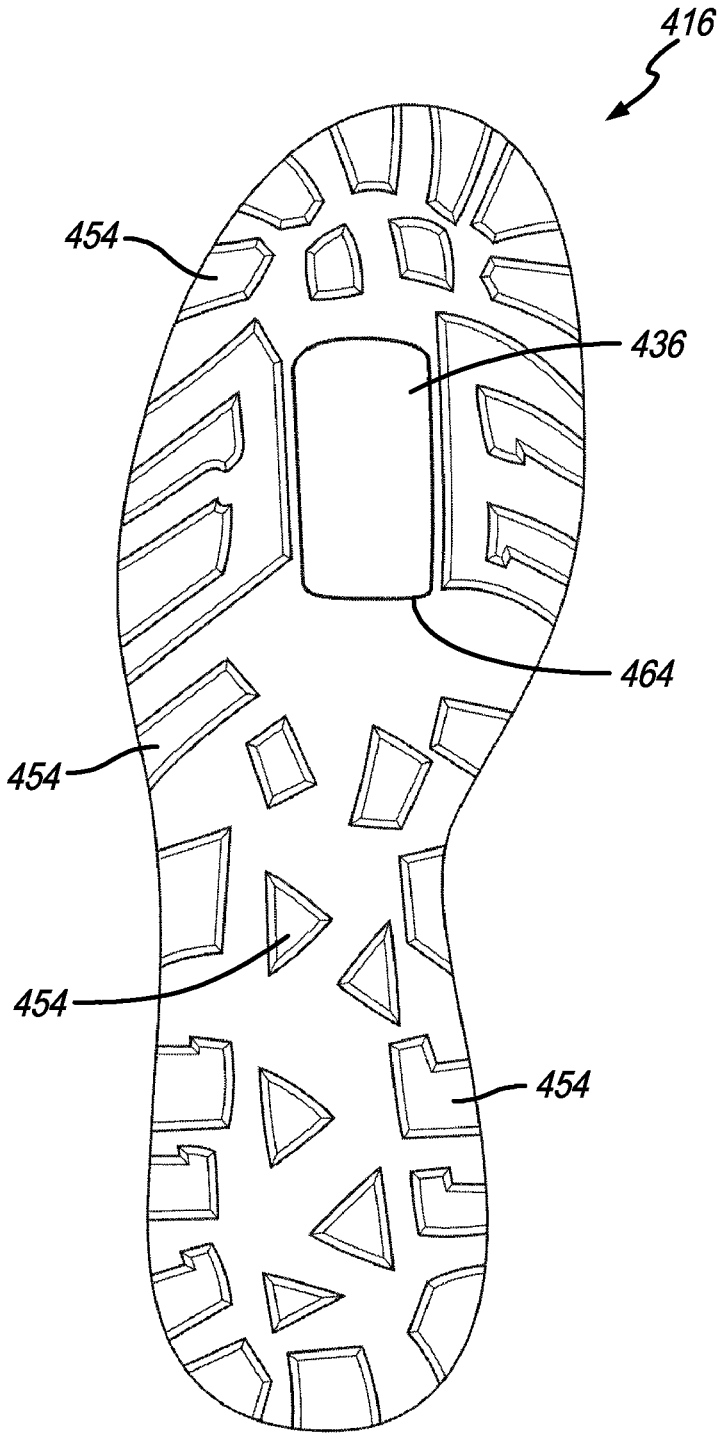
FIG. 4*a*, illustrates another bottom view of an outersole of one embodiment of the invention.

FIG. 4*a* illustrates another embodiment of an outersole 416 of the invention. In this embodiment, the cleat region 436 of the midsole is covered with an outer cleat region cover 464. The outer cleat region cover 464 covers the cleat region 436 and is preferably composed of a durable polymeric material that may be similar or identical to the material forming the outersole 416. The cleat cover may be removable by the user to attach a cleat to the shoe. This embodiment may still provide sufficient force transfer by providing a high rigidity material in the sole of the shoe. Optional tread elements 454 may be included on the outersole 416.

Figure 4B:
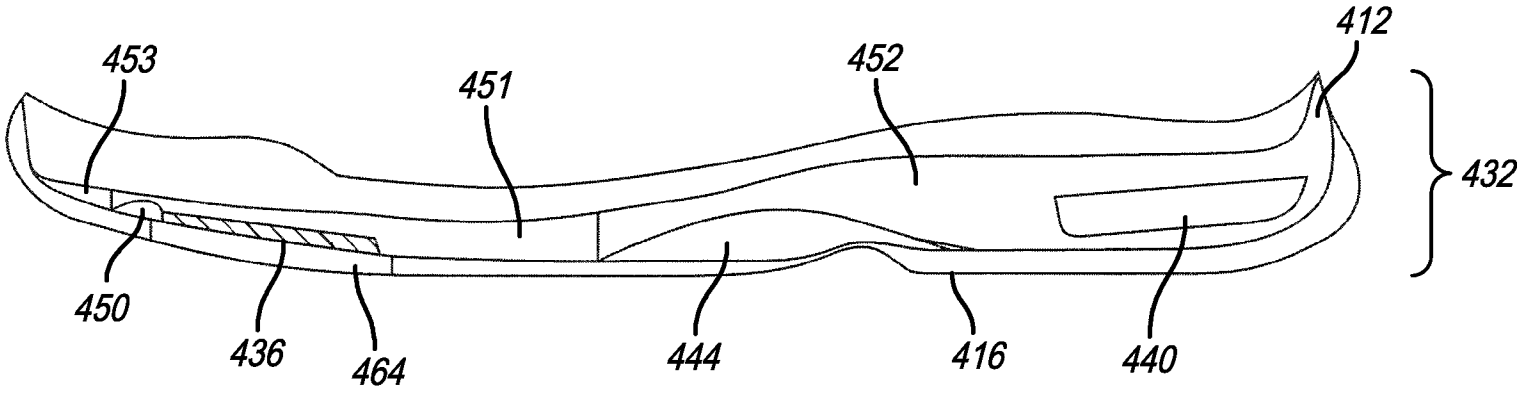
FIG. 4*b*, illustrates a sectional view of an outersole of one embodiment of the invention.

FIG. 4*b* is a sectional side view of the sole of FIG. 4*a*. This sectional view of FIG. 4*b* shows the sole 432, including the outersole 416 and the midsole 412. The cleat region 436 is covered with a cleat region cover 464. FIG. 4*b* also illustrates an embodiment including the optional heel insert 440, optional metatarsal insert 450, and optional arch insert 444 within the midsole 412. Also illustrated are the fore midsole 453, the central midsole 451 and the rear midsole 452 regions of the midsole 412. The rigidity of the material of the cleat region 436 is higher than the rigidity of the material in the rear midsole 452 region of the midsole 412. The difference in densities allow for good force transfer between the riders' foot and pedal in the cleat region 436 while providing greater flexibility and comfort in the remaining regions of the midsole 412.

Figure 5:
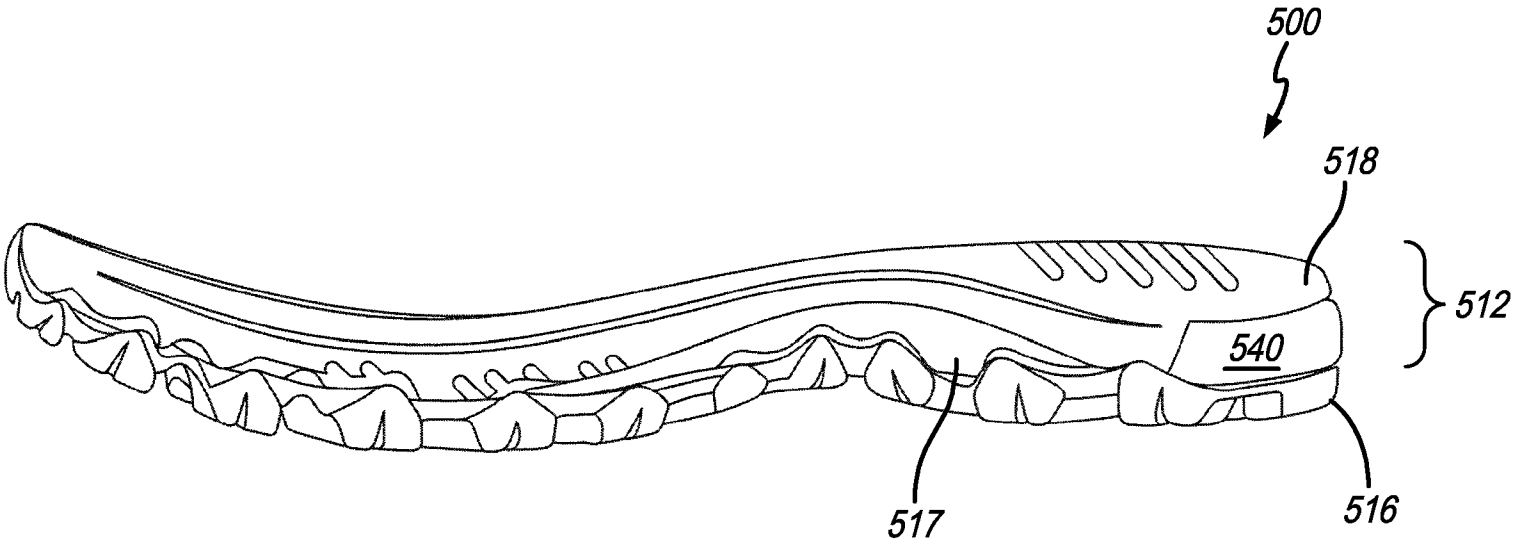
FIG. 5, is a photograph of a side view of a dual rigidity midsole of one embodiment of the invention.

FIG. 5 is a side view of a preferred embodiment of a sole 500 comprising midsole 512 and outersole 516. The midsole 512 includes a heel insert 540, a low rigidity material 518, which contacts the upper of a shoe. The midsole 512 further comprises a high rigidity material 517, which extends from the metatarsal region, above the cleat region of the midsole of the shoe, through the arch portion of the midsole 512.

Figure 6A:
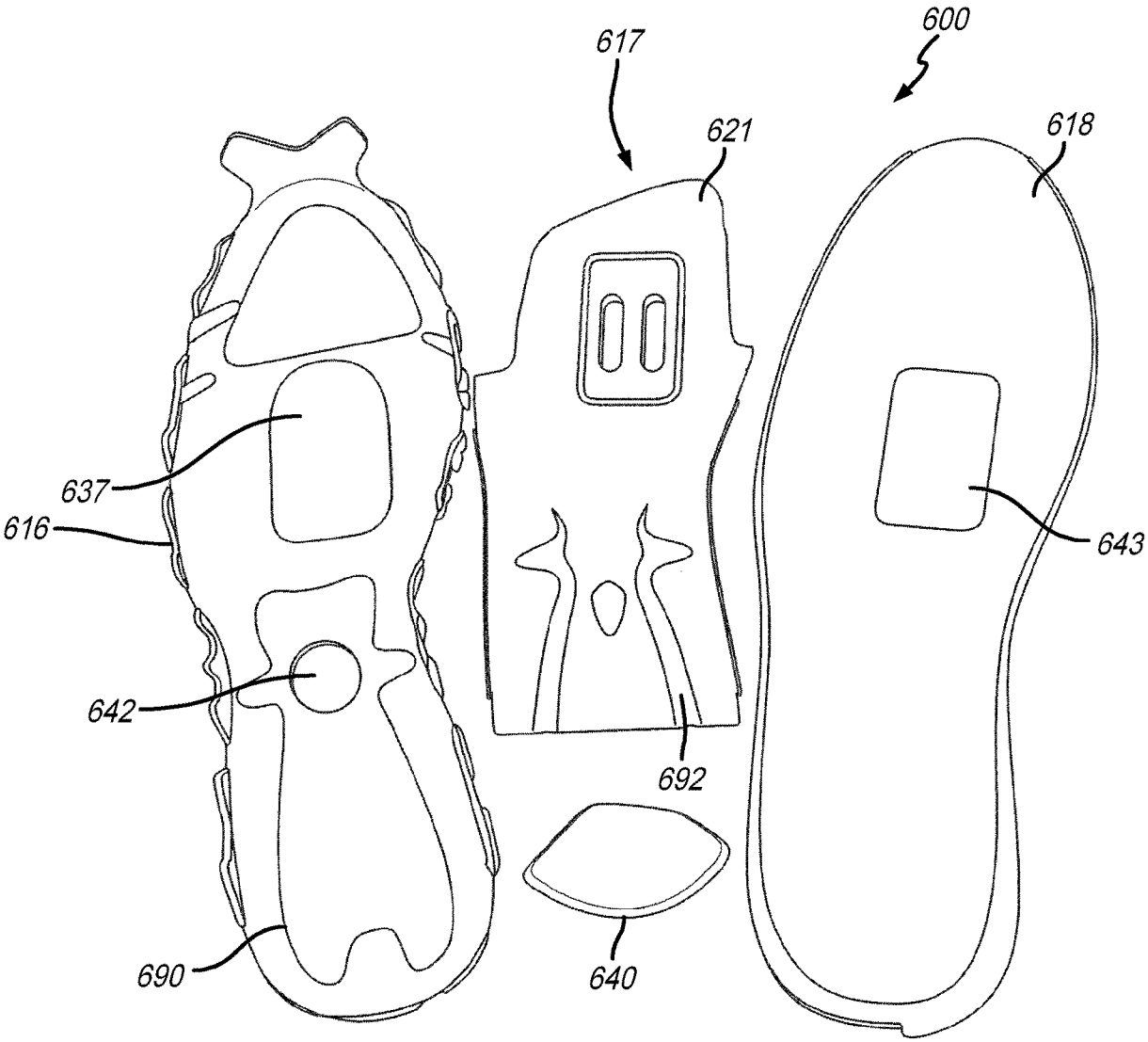
FIG. 6*a*, illustrates an exploded view of a dual rigidity midsole of one embodiment of the invention.

FIG. 6*a* shows an expanded top view of one embodiment of a sole 600. The top view of the outersole 616 illustrates an opening 637 for the cleat region 636 of the high rigidity material 617. An optional advertising opening 642 is included in the embodiment depicted in FIG. 6*a*. The advertising opening 642 allows for advertisements, team logos or brands located on a corresponding region of the high rigidity material 617 to show through the outersole 616 of the shoe. The advertising opening 642 may be any suitable shape or size and may be located throughout the outersole 616 or at multiple locations in the outersole 616. The advertising opening 642 does not interfere with the opening 637. The outersole 616 may also comprise fitting shapes 690 that are recessed such that the high rigidity fitted shape 692 and/or inserts, including the heel insert 640 can fit into the fitting shapes 690 and hold the high rigidity material 617 and/or the inserts in place.

The high rigidity material 617 includes the cleat region 636 of the high rigidity material 617. The high rigidity material 617 can extend through a portion of the metatarsal region, through the arch region and to the rear of the midsole. In the embodiment depicted in FIG. 6*a*, the metatarsal region does not extend to the heel region of the midsole. Optional high rigidity fitted shape 692 protrudes upwardly (see FIG. 6A) or downwardly (see FIG. 6B) from the main body portion 621 and may be used to align the high rigidity material 617 with the fitted shapes 690 of the outersole 616. The high rigidity fitted shape 692 and the fitting shape 690 may be any suitable shape and may be located at one or more location(s) in the sole 600. The heel insert 640 is also illustrated in the expanded view of sole 600. The low rigidity material 618 with an optional opening 643 allows for the cleat region 636 of the high rigidity material 617 to contact the upper of the shoe, allowing for better contact between the rider and a bicycle pedal.

Figure 6B:
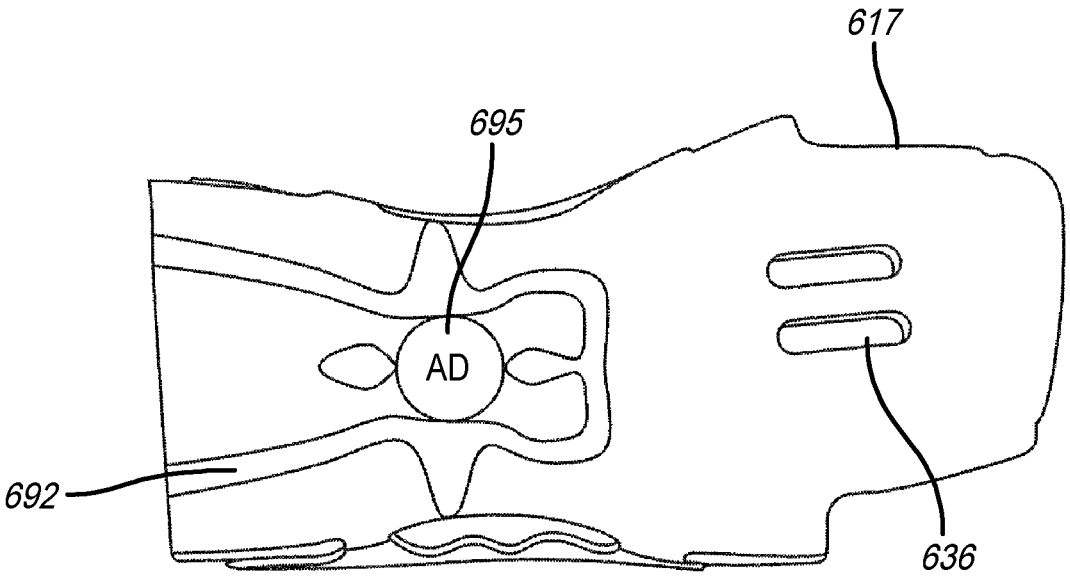
FIG. 6*b*, illustrates a back view of a high rigidity midsole material of one embodiment of the invention.

FIG. 6*b* illustrates the bottom view of the high rigidity material 617 that forms part of the sole 600 illustrated in FIG. 6*a*. Optional advertising may be placed on the high rigidity material 617 at location 695. Also illustrated is the cleat region 636 of the high rigidity material 617. The pedal region 636 of the high rigidity material 617 may be exposed through the outersole such that good contact may be made between the midsole and a bicycle pedal. The thickness of the high rigidity material 617 may vary.

Though the specification discusses the use of the invention as it relates to bicycling shoes, it is understood that aspects of the invention may be used in other footwear, which also fall within the description of the invention.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain the best mode known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A sole for a cycling shoe, comprising:

a midsole that includes an opening defined therein, an outersole positioned beneath the midsole, wherein the outersole includes a plurality of tread elements on a bottom thereof, and a rigid material member that includes a main body portion having a front edge and a rear edge and that is positioned between the midsole and the outersole, wherein a flexible toe region is defined between the front edge and a curved front of the sole, and wherein a flexible heel region is defined between the rear edge and a curved rear of the sole, wherein the midsole and the outersole together define a sole length that extends from a toe region at the curved front of the sole, through a metatarsal region, through an arch region and to a heel region at the curved rear of the sole, wherein the rigid material member has a length that is shorter than the sole length, wherein the rigid material member extends from the metatarsal region and to the arch region and the front edge does not extend to a front of the toe region and the rear edge does not extend to a back of the heel region, wherein the rigid material member includes a fitted shape protruding therefrom that is received in a fitting recess, and wherein the fitted shape is formed as a single piece with the rigid material member.

2. The sole of claim 1 wherein a majority of the front edge is straight and a majority of the rear edge is straight, the rigid material member includes a cleat region that includes a cleat attachment element, and wherein at least a portion of the fitted shape is located in the arch region of the sole and is positioned between the cleat attachment element and the heel region.

3. The sole of claim 1 wherein at least a portion of the cleat region is open to the opening defined in the midsole, such that when the sole is used in the cycling shoe, the rigid material member can contact an upper of the cycling shoe.

4. The sole of claim 1 wherein the outersole includes an advertising opening defined therein, wherein an advertising protrusion extends downwardly into the advertising opening, and wherein the advertising protrusion includes advertising thereon.

5. A sole for a cycling shoe, comprising:

a midsole that includes an opening defined therein, an outersole positioned beneath the midsole, wherein the outersole includes a plurality of tread elements on a bottom thereof, wherein the outersole includes an advertising opening defined therein, wherein an advertising protrusion extends downwardly into the advertising opening, and wherein the advertising protrusion includes advertising thereon, and a rigid material member that includes a main body portion having a front edge and a rear edge and that is positioned between the midsole and the outersole, wherein a majority of the front edge is straight and a majority of the rear edge is straight, wherein a flexible toe region is defined between the front edge and a curved front of the sole, and wherein a flexible heel region is defined between the rear edge and a curved rear of the sole, wherein the rigid material member includes a cleat region that includes a cleat attachment element, wherein at least a portion of the cleat region is open to the opening defined in the midsole, such that when the sole is used in the cycling shoe, the rigid material member can contact an upper of the cycling shoe, wherein the midsole and the outersole together define a sole length that extends from a toe region at the curved front of the sole, through a metatarsal region, through an arch region and to a heel region at the curved rear of the sole, wherein the rigid material member has a length that is shorter than the sole length, wherein the rigid material member extends from the metatarsal region and to the arch region and the front edge does not extend to a front of the toe region and the rear edge does not extend to a back of the heel region, wherein the rigid material member includes a fitted shape protruding therefrom that is received in a fitting recess, and wherein the fitted shape is formed as a single piece with the rigid material member.

6. A cycling shoe comprising:

an outersole that includes a cleat opening defined therein and a plurality of tread elements on a bottom thereof, wherein the outersole defines a concave front edge and a concave rear edge, and wherein the outersole defines an outersole length that extends from the front edge through a toe region at a front of the outersole, through a metatarsal region, through an arch region, through a heel region at a rear of the outersole and to the rear edge, an upper attached to the outersole, wherein the upper defines an upper length, and a rigid material member that is positioned between the upper and the outersole, wherein the rigid material member includes a cleat attachment element that includes first and second elongated slots defined through the rigid material member, wherein the rigid material member defines a front edge, a rear edge, a medial edge, a lateral edge and defines a longitudinal axis, wherein the medial edge has a length that is longer than the lateral edge, wherein the front edge forms a non-right angle with the longitudinal axis, wherein the front edge extends rearwardly from a front most portion of the medial edge to a front most portion of the lateral edge, wherein a majority of the front edge defines a front edge straight portion, wherein a flexible toe region is defined between the front edge straight portion and the curved front edge of the outersole, and wherein a flexible heel region is defined between the rear edge of the rigid material member and the curved rear edge of the outersole, wherein the rigid material member defines a rigid material member length that is shorter than the outersole length and extends from the metatarsal region and to the arch region and does not extend to a front of the toe region or to a back of the heel region, and wherein the rigid material member length is less than both the outersole length and the upper length.

7. The cycling shoe of claim 6 wherein the outersole includes a top surface and the upper includes a bottom surface, and wherein the rigid material member is sandwiched between the top surface of the outersole and the bottom surface of the upper.

8. A sole for a cycling shoe, comprising:

a midsole that includes an opening defined therein, an outersole positioned beneath the midsole, wherein the outersole includes a plurality of tread elements on a bottom thereof, and a rigid material member that includes a main body portion having a front edge and a rear edge and that is positioned between the midsole and the outersole, wherein a flexible toe region is defined between the front edge and a curved front of the sole, and wherein a flexible heel region is defined between the rear edge and a curved rear of the sole, wherein the midsole and the outersole together define a sole length that extends from a toe region at the curved front of the sole, through a metatarsal region, through an arch region and to a heel region at the curved rear of the sole, wherein the rigid material member has a length that is shorter than the sole length, wherein the rigid material member extends from the metatarsal region and to the arch region and the front edge does not extend to a front of the toe region and the rear edge does not extend to a back of the heel region, wherein the rigid material member includes the front edge, a medial edge, a lateral edge and defines a longitudinal axis, wherein the medial edge has a length that is longer than the lateral edge, wherein the front edge forms a non-right angle with the longitudinal axis, and wherein the front edge extends rearwardly from a front most portion of the medial edge to a front most portion of the lateral edge.

* * * * *